United States Patent [19]

Jordan

[11] 4,283,061

[45] Aug. 11, 1981

[54] BLOW GUN DART

[76] Inventor: Rolf W. Jordan, ISAR Strasse 93, 2800 Bremen, Fed. Rep. of Germany

[21] Appl. No.: 147,388

[22] Filed: May 7, 1980

[51] Int. Cl.[3] ..... F41B 1/02

[52] U.S. Cl. ..... 273/423

[58] Field of Search ..... 273/416, 418–423

[56] References Cited

U.S. PATENT DOCUMENTS

| | | | |
|---|---|---|---|
| 186,651 | 1/1877 | White | 273/423 X |
| 873,628 | 12/1907 | Stivers | 273/416 |
| 1,609,013 | 11/1926 | De Cavin | 273/423 X |
| 2,753,860 | 7/1956 | Schanz | 273/416 X |
| 3,404,669 | 10/1968 | Null | 273/416 X |
| 3,457,921 | 7/1969 | Waldeisen | 273/418 X |
| 3,735,748 | 5/1973 | Gaylord | 273/416 X |

FOREIGN PATENT DOCUMENTS

| | | | |
|---|---|---|---|
| 649397 | 8/1937 | Fed. Rep. of Germany | 273/416 |
| 2507950 | 9/1976 | Fed. Rep. of Germany | 273/420 |
| 460509 | 12/1950 | Italy | 273/423 |
| 80686 | 9/1952 | Norway | 273/420 |

*Primary Examiner*—Paul E. Shapiro

*Attorney, Agent, or Firm*—Robert J. Mooney

[57] ABSTRACT

A blow gun dart having an elongated specially tapered shaft which is provided with a specially shaped impeller. The special design of the dart enables it to traverse an exceptionally long distance over a substantially straight path. Wings may be added to the shaft of the dart to improve its aerodynamic performance. Alternatively the impeller may be mounted on a foreshortened shaft having a distended section in the forward portion of the shaft.

12 Claims, 8 Drawing Figures

BLOW GUN DART

BACKGROUND OF THE INVENTION

This invention is directed to a dart and in particular to a blow gun dart.

Blow guns and darts are well known. However, darts of conventional construction have several drawbacks. The most important of these drawbacks is the inability of such darts to accurately traverse relatively long distances over substantially straight paths because of aerodynamic imperfections such as mispositioned centers of gravity.

SUMMARY OF THE INVENTION

Accordingly, it is an object of this invention to provide a blow gun dart which accurately traverses relatively large distances; it is a further object of this invention to provide a blow gun dart with an optimally placed center of gravity that is rendered aerodynamically stable; it is a further object of this invention to provide a blow gun dart with optimum aerodynamic characteristics which enable the dart to traverse a substantially straight path over an exceptionally long distance. These and other objects of the invention are achieved as follows.

The dart of this invention is provided with an elongated shaft so tapered that its forward portion is rendered heavier than its rear portion. Hence, the center of gravity of the shaft is located in the shaft's forward portion. The rear portion of the shaft is provided with a specially sized, shaped and weighted impeller which may be rendered in various hollow or solid forms. The weight of the impeller is kept within a predetermined range to insure that the center of gravity of the dart remains in the forward portion of the shaft. In all embodiments, the impeller is provided with a conical forward section having a specially selected included angle of 45°±3° with respect to the axis of the shaft.

Alternatively the impeller may be mounted upon a foreshortened shaft having a distended section in the foreward portion of the shaft.

The specially angled conical section of the impeller, the location of the dart's center of gravity in the forward portion of the shaft, and the length of the tapered shaft all combine to produce a blow gun dart that is aerodynamically stable and capable of traversing large distances over a substantially straight path. Wings may be added to both versions of the shaft to enhance the aerodynamic performance of the dart.

Other objects, advantages and novel features of the invention will become apparent from the following detailed description of the invention when considered in conjunction with the accompanying drawings.

FIG. **6*a*** illustrates a second embodiment of the shaft of the dart.

FIG. **6*b*** illustrates an impeller attached to the second embodiment of the shaft.

DESCRIPTION OF THE PREFERRED EMBODIMENT

Figure 1:
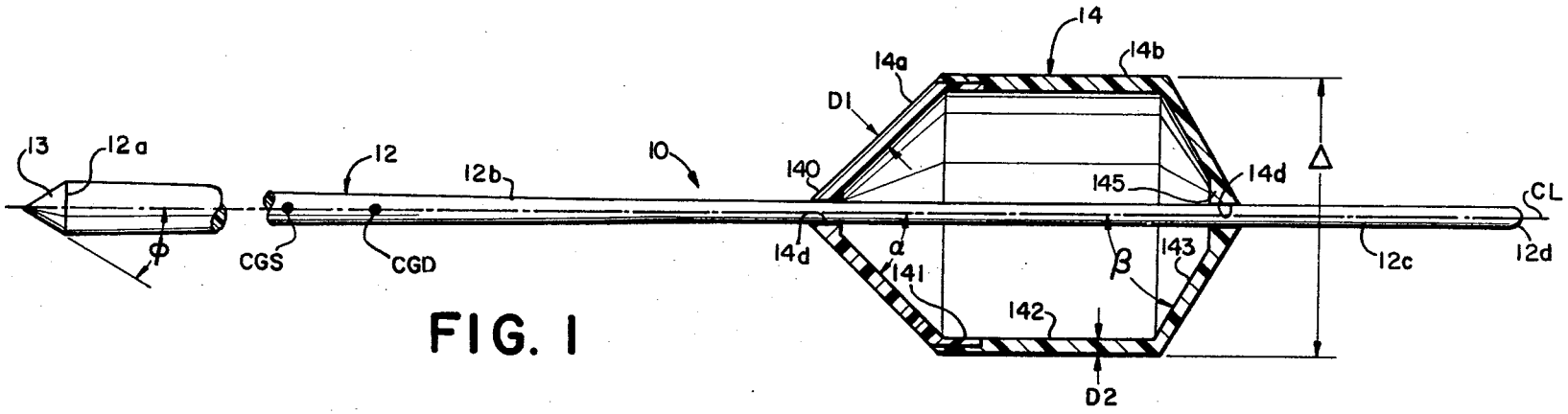
FIG. 1 is a partially cross-sectioned side elevational view of the dart of this invention which view highlights a part of the dart known as an impeller.
Figure 1A:
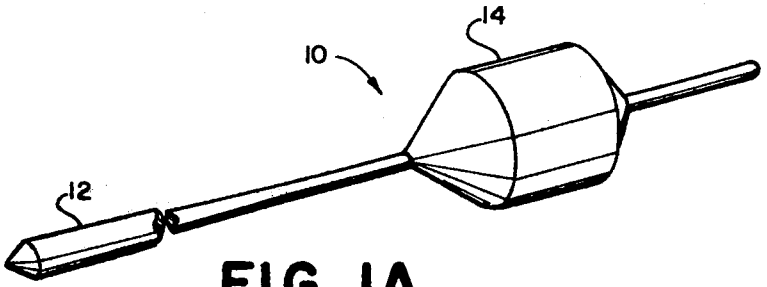
FIG. 1a is an isometric illustration of the dart shown in FIG. 1.

In FIG. 1, a partially cross-sectioned side elevational view of the dart 10 is presented, and in FIG. 1a an isometric view of the dart 10 is presented. The dart 10 includes an elongated monolithic tapered shaft 12 preferably made from fiberglass. The rearward portion 12b of the shaft 12 is provided with a hollow impeller 14 which is glued or otherwise secured to the shaft 12. The front end **12*a* of the shaft 12 is provided with a conical tip 13 having a preferred base diameter of 2 mm±0.5 mm and an included angle $\phi$ of 30° with respect to the center line CL of the shaft 12**.

In a first embodiment illustrated in FIG. 1, the shaft 12 has a length of 260 mm±10 mm. The shaft 12 is tapered and has a circular cross-section throughout its length. At the base of the conical tip 13, the forward portion 12b of the shaft 12 has a diameter of 2 mm±0.5 mm. The rearward end of the shaft 12 has a diameter of 0.8 mm±0.3 mm. The tapered construction of the shaft 12 insures that the center of gravity CGS of the shaft 12 is in the forward portion 12b of the shaft to thereby enhance the aerodynamic characteristics of the dart.

In a preferred embodiment, the impeller 14 is hollow and is composed of two parts, the forward portion **14*a* and the rear portion 14b. The forward portion 14a is a monolithic structure which is substantially conically shaped with an included angle, $\alpha$, ranging from 45° to 48° with respect to the center line CL of the shaft 12**.

Through experimentation it has been determined that the value of the included angle $\alpha$ is critical. An included angle, $\alpha$, having a value ranging from 45° to 48° represents a balance between competing aerodynamic considerations. Through experimentation it has been determined that such value represents an optimum value which enhances the ability of the dart 10 to slice through the air in a substantially straight line for exceptionally long distances. Tests with experienced blow gun operators have shown that the dart 10 of this invention can be considerably and accurately delivered to a target twelve to fifteen meters from the operator.

The thickness, D1, of the forward portion **14*a* of the impeller 14 is preferably 0.3 mm over most of its surface. The tip 140 of the forward portion of the impeller is made slightly thicker to facilitate its joinder to the rearward portion 12*c* of the shaft 12 by gluing or other suitable means. The rearward terminus of the forward portion 14*a* is provided with a cylindrically shaped skirt 141 which is coaxial with the center line CL of the shaft 12 and is preferably 0.15 mm in thickness. The reduced thickness shirt 141 provides a landing for a lap joint securement of the forward portion 14*a* to the rear portion 14*b* of the impeller 14**.

The rear portion **14*b* of the impeller 14 is also a monolithic structure which is comprised of a cylindrical section 142 terminating in a conical section 143 having an included angle, $\beta$, of 60°±3° with respect to the Center Line CL of the shaft 12. In a preferred embodiment the rear portion 14*b* has a thickness D2 of 0.5 mm and its fore-end is provided with a beveled landing 144 which is half as thick to facilitate a lap joint securement to the forward portion 14*a* of the impeller 14. The exterior diameter $\Delta$ of the cylindrical section 142 is preferably 10 mm±0.1 mm. The thickness of the aft end 145 of the rear portion 14***b* of the impeller 14 is increased somewhat to facilitate securement of the rear portion 14*b* of the impeller 14 to the shaft 12.

When the forward 14*a* and rear 14*b* portions of the impeller 14 are joined together, the impeller 14 is preferably 10.5 mm to 14.5 mm in length. Both the forward 14*a* and rear 14*b* portions of the impeller 14 are provided with suitably sized holes 14*d* which accommodate the tapered shaft 12.

The sloped conical section 143 of the rear portion 14*b* of the impeller 14 performs two functions: it provides the surface upon which the breath of the blow gun operator impinges to thereby propel the dart 10 through a blow gun to a target and, once the dart 10 is embedded in a target, it provides a sloped surface which tends to deflect subsequently blown darts to thereby minimize damage to a dart 10 already embedded in a target.

The aft end 145 of the impeller 14 is preferably 10 mm±8 mm from the aft end 12*d* of the shaft 12. An impeller 14 constructed in accordance with the foregoing is strong, lightweight and imparts aerodynamic stability to the dart 10. The impeller 14 is deliberately made thin-walled and its overall diameter is deliberately kept at or below 10 mm. Therefore, the combined weight and placement of the impeller 14 and the distributed weight of the shaft 12 combine to fix the center of gravity CGD of the dart 10 in the forward portion 12*b* of the shaft 12. With the dart's 10 center of gravity CGD located in the forward portion 12*b* of the shaft 12, the dart 10 is rendered aerodynamically stable.

The impeller 14 is preferably made from a lightweight but sturdy material such as polypropylene or from material having similar qualities.

The unique ability of the dart 10 of the present invention to traverse an exceptionally long distance along a substantially straight path is brought about by the combined effect of the following factors: the length of the shaft 12, the tapered configuration of the shaft 12 placing most of its weight in its forward portion 12*b*, the fixing of the dart's center of gravity, CGD, in the forward portion 12*b* of the shaft 12 of the dart and the lightweight impeller with the specially selected included cone angle $\alpha$.

Figure 2:
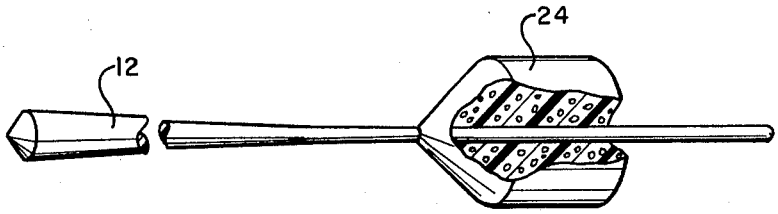
FIG. 2 illustrates a second embodiment of the impeller.

The hollow impeller 14 may be rendered from a solid material provided always that the specially selected cone angle, $\alpha$, is maintained and provided also that the weight of the solid impeller is not so large as to shift the center of gravity of the dart 10 out of the forward portion 12*b* of the shaft 12. FIG. 2 is a cross-section of a solid impeller 24 which is preferably made from Styrofoam or other similar and suitable material. The solid impeller 24 preferably weighs 0.210 grams±0.100 grams; its diameter is preferably 10 mm±0.1 mm; and its length ranges from 10.5 mm±14.5 mm.

Figure 3:
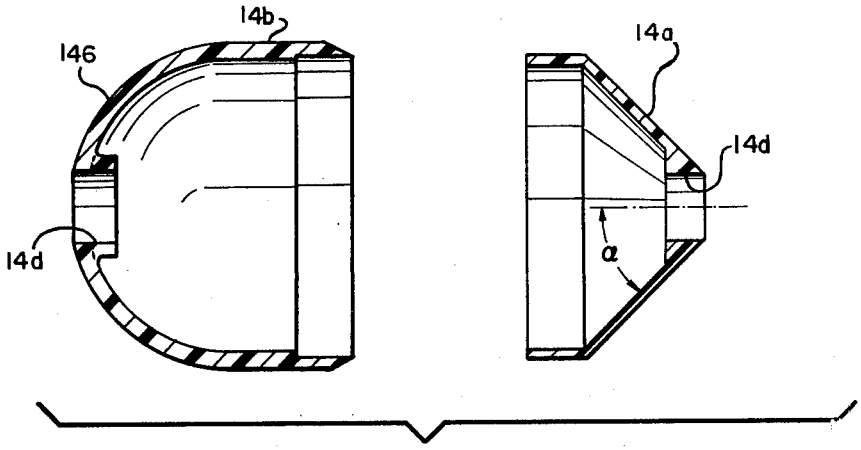
FIG. 3 illustrates a third embodiment of the impeller.

The rear portion 14*b* of the hollow impeller 14 may be rendered in several different configurations. For example, instead of terminating in a conical section 143, the rear portion 14*b* of the impeller 14 may terminate in a dome section 146 as shown in FIG. 3. The dome section 146 reduces the partial vacuum which is created as the dart 10 pushes through the air and hence increases the speed of a dart 10 so equipped. However, an impeller 14 with a dome section 146 requires the blow gun operator to blow harder in order to propel such a dart through a blow gun.

To insure that the center of gravity of the dart is in the forward portion of the shaft, the tip of the shaft may be enlarged or made from a heavier material than that of the shaft 12 and/or holes may be drilled in the aft end 12*d* of the shaft 12.

Figure 5:
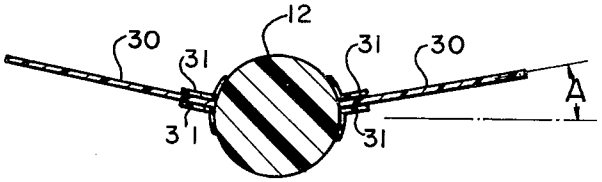
FIG. 5 is a cross-section of the dart shown in FIG. 4.
Figure 4:
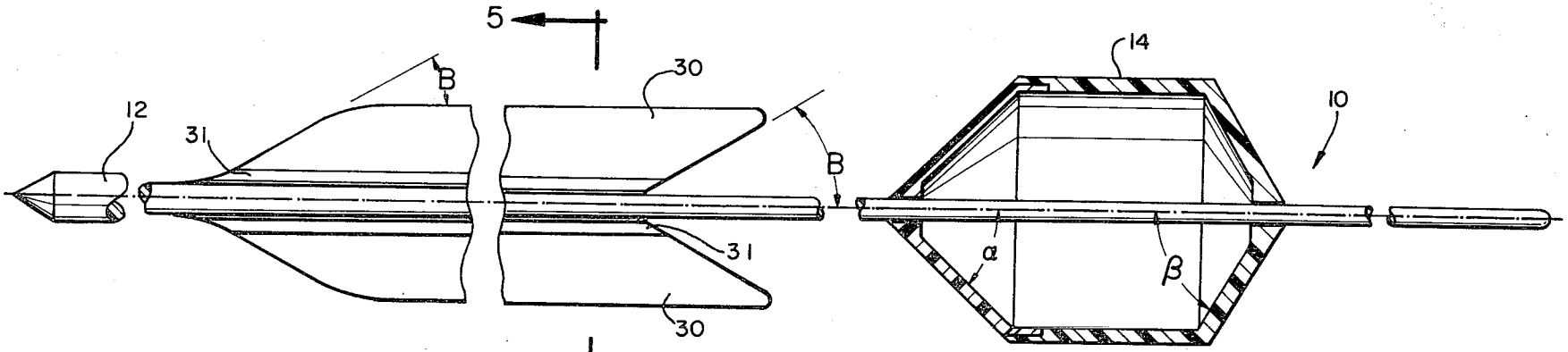
FIG. 4 illustrates a second embodiment of the dart.

A second embodiment of the dart 10 of this invention is shown in FIGS. 4 and 5. The dart 10 shown in FIGS. 4 and 5 is identical to the dart 10 shown in FIG. 1 except that two wings 30 are provided on opposite sides of the shaft 12. The wings 30 are attached to the shaft by suitable means as adhesive.

The wings 30 are preferably made from a lightweight plastic such as plexiglas or its equivalent. Each wing 30 has a length of 100 mm±10 mm and a width of 3.5 mm±1.0 mm. Each wing preferably makes an angle A of 10°±3° with respect to the horizontal. Each wing 30 has a smooth surface. Each wing 30 is very thin and has a thickness of preferably 0.02 mm to 0.40 mm. The fore and aft ends of the wing make an angle B of 60°±3° with respect to the center line of the shaft 12.

To facilitate the attachment of the wings 30 to the shaft 12, the innermost edge of each wing 30 may be provided with an elongated curved tab 31 on either side. The curved tabs 31 are cemented or otherwise secured to the wings 30 or may be made an integral part thereof. In turn the tabs 31 may be cemented or otherwise suitably secured to the shaft 12.

To insure that the center of gravity CGD of the dart 10 remains in the forward portion 12*b* of the dart, the forward end of the wings 30 are preferably spaced 45 mm±5 mm from the tip 13 of the shaft 12.

The addition of the very lightweight wings does not significantly alter the preferred position of the center of gravity CGD of the dart 10. Tests have shown that the winged dart traverses a greater distance than the wingless dart.

Figure 6A:
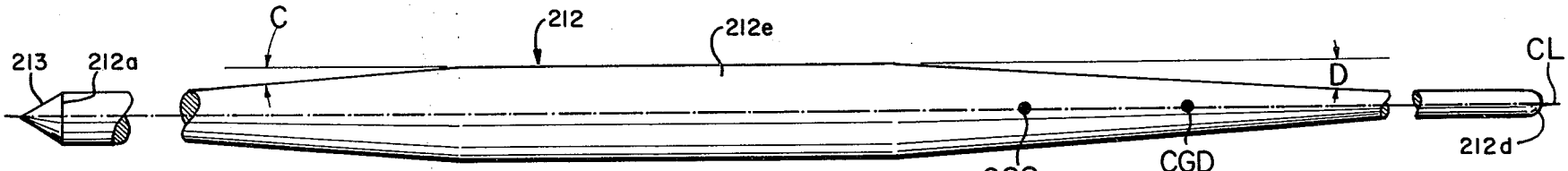

FIG. 6*a* illustrates a second embodiment of the shaft 212. In this version of the dart 210, the shaft 212 is foreshortened but is provided with a distended section 212*e* in the forward portion of the shaft 212.

The shaft 212 has an overall length of 160 mm±10 mm. The most forward part of the shaft has a diameter of 2 mm and extends rearward from the tip 213 a distance of 20 mm±5 mm. At that point the diameter of the shaft gradually increases, at an angle C of 4°±0.3° over a length of 10 mm, until it attains a value of 3.6 mm±0.5 mm. The distended section 212*e* of the shaft extends rearward for 16 mm. At that point, the diameter of the shaft gradually decreases, at an angle D of 5°±0.3° over a length of 19 mm±3 mm, until it attains a value of 1 mm±0.5 mm. Thereafter, the shaft 212 extends an additional 95 mm with a diameter of 1 mm±0.5 mm.

Figure 6B:
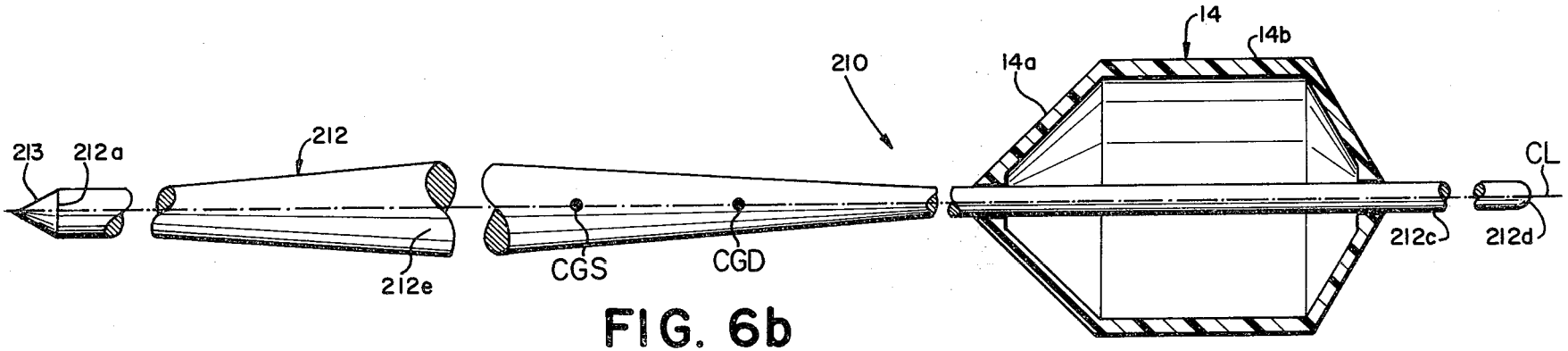

FIG. 6*b* illustrates the impeller 14 of FIG. 1*a* mounted on the shaft 212. The rear section of the impeller 14 is located 10 mm±8 mm from the end 212*d* of the shaft 212.

Even though the shaft 212 has been foreshortened, the distended section provides added weight to the forward portion of the shaft 212. Hence, as before, the center of gravity of the dart, CGD, is located in the foreward protion of the dart 210 some 57 mm from the tip 213 of the shaft 212.

As with the version shown in FIG. 4 wings may be added to the version of the dart 210 shown in FIG. 6*b*.

Obviously, other embodiments and modifications of the present invention will readily come to those of ordinary skill in the art having the benefit of the teachings presented in the foregoing description and drawings. It is therefore understood that various changes in the details, materials, steps, and arrangement of parts, which have been described and illustrated to explain the nature of the invention, may be made by those skilled in the art within the principle and scope of the invention as expressed in the appended claims.

I claim:

1. A blow gun dart comprising:

an elongated shaft tapering from tip to tail wherein the forward portion of the shaft has a diameter larger than the rearward portion of the shaft;

a hollow impeller secured to the rearward portion of said elongated shaft;

said hollow impeller including a conical forward section having a first predetermined included angle with respect to the center line of the shaft and a rearward section containing a conical portion having a second predetermined angle with respect to the center line of the shaft; and wherein the center of gravity of said dart is located in the forward portion of said elongated shaft.

2. A blow gun dart according to claim 1 further including:

two elongated wings secured to opposite sides of the forward portion of said shaft in front of said impeller.

3. A blow gun dart according to claim 2 wherein said first predetermined angle is 45°±3°.

4. A blow gun dart according to claim 2 wherein said second predetermined angle is 60°±3°.

5. A blow gun dart according to claim 1 wherein said first predetermined angle is 45°±3°.

6. A blow gun dart according to claim 1 wherein said second predetermined angle is 60°±3°.

7. A blow gun dart comprising:

an elongated shaft having a first portion with a first diameter, a second portion contiguous to and integral with the first portion and having a second diameter greater than the first diameter, and a third portion contiguous to the second portion and integral with the first and second portions and having a third diameter less than the first and second diameters;

a hollow impeller secured to the third portion of said elongated shaft;

said hollow impeller including a conical forward section having a first predetermined included angle with respect to the center line of the shaft and a rearward section containing a conical portion having a second predetermined angle with respect to the center line of the shaft; and wherein the center of gravity of said dart is located forward of the midpoint of said shaft.

8. A blow gun dart according to claim 7 further including:

two elongated wings secured to opposite sides of the forward portion of said shaft in front of said impeller.

9. A blow gun dart according to claim 8 wherein said first predetermined angle is 45°±3°.

10. A blow gun dart according to claim 8 wherein said second predetermined angle is 60°±3°.

11. A blow gun dart according to claim 7 wherein said first predetermined angle is 45°±3°.

12. A blow gun dart according to claim 7 wherein said second predetermined angle is 60°±3°.

* * * * *